US005424516A

United States Patent [19]

Emmons

[11] Patent Number: 5,424,516

[45] Date of Patent: Jun. 13, 1995

[54] LOW PROFILE PUSHBUTTON SWITCH

[76] Inventor: Charles E. Emmons, 155 W. Sharon Rd., Cincinnati, Ohio 45246

[21] Appl. No.: 125,584

[22] Filed: Sep. 23, 1993

[51] Int. Cl.[6] ..... H01H 3/12

[52] U.S. Cl. ..... 200/344; 200/517; 200/341

[58] Field of Search ..... 200/341–345, 200/520, 517, 5 A

[56] References Cited

U.S. PATENT DOCUMENTS

| | | | |
|---|---|---|---|
| 3,292,761 | 12/1966 | Erpel | 200/344 X |
| 4,384,796 | 5/1983 | Denley . | |
| 4,392,037 | 7/1983 | Fleming . | |
| 4,433,225 | 2/1984 | Cowles . | |
| 4,453,063 | 6/1984 | Wanatowicz, Jr. et al. . | |
| 4,468,145 | 8/1984 | Denley . | |
| 4,475,832 | 10/1984 | Wachs | 200/344 X |
| 4,535,210 | 8/1985 | Shedore et al. . | |
| 4,580,022 | 4/1986 | Oelech et al. . | |
| 4,771,146 | 9/1988 | Suzuki et al. . | |
| 4,950,093 | 8/1990 | Ertl . | |
| 5,003,140 | 3/1991 | Abell, Jr. et al. . | |
| 5,120,923 | 6/1992 | Kato et al. . | |
| 5,268,545 | 12/1993 | Bruner . | |
| 5,278,371 | 1/1994 | Watanabe et al. . | |
| 5,278,372 | 1/1994 | Takagi et al. . | |
| 5,278,374 | 1/1994 | Takagi et al. . | |
| 5,280,147 | 1/1994 | Mochizuki et al. . | |

*Primary Examiner*—Ernest G. Cusick
*Attorney, Agent, or Firm*—Frost & Jacobs

[57] ABSTRACT

A low profile electronic pushbutton switch, useful for computer keyboards, is provided having stabilization in both of its horizontal axes, thereby preventing binding of the switch's bearing surfaces and preventing tilting of the upper surface of the switch while being operated. The stabilization is achieved by a pair of yokes that are positioned at 90° angles from one another, and which provide stability to keep the upper surface of the pushbutton switch normal to the direction of depression as the switch is actuated. The yokes are mounted via a "living hinge" to the base surface of the keyboard and to a moveable frame portion that is rigidly attached to the upper cap of the pushbutton switch. The yokes are also movably attached, via a pair of stems, to horizontal slots in the moveable frame portion and to the base. As the switch is depressed, the stems of the yokes will move in the horizontal direction within their horizontal slots to allow stabilized vertical movement of the moveable frame portion. The yokes have center portions which are cut out so as to allow the two yokes to be interleaved within one another, thereby allowing the yokes to both fit within the confines of the moveable frame portion. Utilizing this design, the stroke-to-profile ratio is maximized.

21 Claims, 6 Drawing Sheets

LOW PROFILE PUSHBUTTON SWITCH

TECHNICAL FIELD

The present invention relates generally to pushbutton switches used in computer keyboards and is particularly directed to a low profile pushbutton switch of the type which is stabilized so that the upper cap always remains substantially horizontal in a typical application. The invention is specifically disclosed as a pushbutton switch for a notebook computer that has dual stabilization about two horizontal axes that are 90° from each other.

BACKGROUND OF THE INVENTION

Pushbutton switches are employed in many types of electronic equipment, including keyboards for typewriters, computers, and other similar devices. In portable electronic equipment, it is usually important to make the keyboard pushbuttons relatively small and arrange to have them closely spaced to one another, and additionally, to have the keys exhibit "low profile" characteristics. A low profile pushbutton switch is one that has a minimal side profile (i.e., its height in the undepressed position) to save space in the vertical dimension. For ergonomic reasons, however, it is preferable that the switches have a full travel stroke in the direction of depression of at least three millimeters (3.0 mm), whether or not such switches are low profile in nature.

In addition to occupying a minimal amount of space on a keyboard (i.e., having a small "footprint"), it is also important that a pushbutton actuator (e.g., used as a key or keyboard switch) does not demonstrate any resistance or binding during actuation. In order to save space, the full travel stroke of some existing low profile key switches is often reduced to only two millimeters (2.0 mm) to save space. In existing pushbutton switches that use vertical sliding bearings, the length of the sliding bearings are also reduced to save space, which means less surface area for the engagement portion of the vertical sliding bearings while in the "up" position, leading to an unstable situation where binding can often occur when the key switches are actuated off-center.

To prevent binding, or to minimize its effects, some of the existing pushbutton switches use some type of stabilizer in an attempt to maintain the upper surface of the switch in the horizontal plane while being depressed. For example, U.S. Pat. No. 5,003,140 (by Abbell Jr., et al.) discloses a stabilizer for a "long" keyboard pushbutton switch. In Abbell, a pair of moveable arms are interconnected by a shaft which runs in a direction parallel to the length of the long keyboard switch. The opposite ends of the arms from the interconnecting shaft are connected to the keyboard pushbutton switch using a thin serpentine section to distribute the stress and force involved as the keyboard pushbutton switch is depressed. The Abbell keyboard pushbutton switch also has a vertical sliding bearing surface to stabilize the keyboard pushbutton switch in one direction while the arms and interconnecting shaft combination stabilize the keyboard pushbutton switch in the other direction (90° from the first direction).

One disadvantage of Abbell is that its design is specifically oriented toward a long keyboard pushbutton switch such as a space bar. If the Abbell design were used in a standard small square keyboard pushbutton switch, its only stabilization in one direction would be via the vertical sliding bearing, which if used in a low profile keyboard, would not have enough surface area to provide the proper stability required for that application. Another disadvantage of Abbell is that its pair of stabilizing arms and interconnecting shaft extend beyond the periphery of the upper cap of the space bar key, and therefore, cannot be used with multiple low profile keys which are to be closely packaged together.

Another patent, by Fleming (U.S. Pat. No. 4,392,037), discloses a pushbutton switch for an electronic keyboard which is stabilized against tilt in two different axes, by use of two anti-roll bars that are attached between the keyboard pushbutton switch and the body of the keyboard. Each anti-roll bar is assembled through lugs along one side of the keyboard pushbutton switch, which is then pressed into position so as to be slidably moveable while held in place by tabs mounted to the upper surface of the keyboard body. The two anti-roll bars are positioned in a 90° orthogonal axis from each other, and from the trajectory of the pushbutton, thereby maintaining the face of the keyboard pushbutton switch normal or perpendicular to the direction of depression. One major disadvantage of the Fleming design is that its two anti-roll bars project away from the sides of the keyboard pushbutton switch, thereby occupying a good deal of space of the keyboard surface. Since the Fleming device was specifically designed for a large area keyboard pushbutton switch (such as the "carriage return" key), the extra area around two of its sides that is used up by the anti-roll bars is not critical. Use of the Fleming design with a large number of closely-spaced keys, however, would be virtually impossible since the anti-roll bars would be in the way of any adjacent closely-spaced keyboard pushbutton switches.

In another patent, by Kato et al. (U.S. Pat. No. 5,120,923), a keyboard pushbutton switch is disclosed having an improved stroke-to-profile ratio. In FIG. 6 herein (which is a partial reproduction of FIG. 13 of Kato et al.) a prior art pushbutton switch is disclosed having a profile "$P_1$" which is defined as the distance between the bottom surface of the key cap (in the switch's undepressed position) and the top surface of the membrane switch that the keyboard pushbutton switch is sitting upon. A stroke "S" is defined as the distance traveled from the undepressed position to the depressed position. For an optimal design, each "S" dimension would be equal to each other, otherwise the profile $P_1$ would be even greater in vertical height than would be necessary.

The stroke-to-profile ratio would be optimally maximized in any keyboard pushbutton switch in situations where it is desired to have a low profile but also to have a large stroke. Since FIG. 6 has a profile $P_1$ that is equal to $(2S)+a_1$, its stroke-to-profile $S/P_1$ ratio is equal to $S/((2\ S)+a_1$. As can be readily discerned from an inspection of this ratio, its value will always be less than 0.5, because dimension "$a_1$" is a physical distance greater than zero that is needed for stability of the prior art pushbutton switch of FIG. 6.

FIG. 5 herein (which is a partial reproduction of FIG. 1 of Kato et al.) depicts another embodiment of a keyboard pushbutton switch having a telescoping design along its bearing surfaces. In FIG. 5 the profile is again defined as the distance from the bottom of the key cap to the top surface of the membrane switch that the keyboard pushbutton switch sits upon. This profile dimension can be defined as "$P_2$", which is equal to the dimension $(2S)+a_2$, in which "$a_2$" is the engagement area between the base and the key cap. Dimension $a_2$is equal to the upper portion of dimension "E" as depicted in FIG. 5. In the embodiment depicted in FIG. 5, the stroke-to-profile ratio $(S/P_2)$ is equal to $S/(2S+a_2)$. As can be easily discerned from a close inspection of the equation, this ratio must always be a number less than 0.5, since $a_2$ is a distance greater than zero.

In low profile keyboards used in space-saving applications, such as notebook computers, it is desirable to maximize the stroke-to-profile ratio so that the overall height (or profile) of the keyboard pushbutton switch is minimized while the stroke (the distance between the depressed and undepressed position of the keyboard pushbutton switch's cap) is maintained at an optimal distance of at least three millimeters. In a truly space-saving design, it would be preferable for the stroke-to-profile ratio of a keyboard pushbutton switch to be in the range between 0.5 and the theoretical maximum of 1.0. Since the design of FIG. 5 necessarily has a stroke-to-profile ratio of less than 0.5 it is apparent that its design does not fit within the optimal range.

SUMMARY OF THE INVENTION

Accordingly, it is a primary object of the present invention to provide a low profile pushbutton switch having a stroke-to-profile ratio greater than 0.5, in which the profile is defined as the distance between the bottom of the key cap and the top of the membrane switch surface that the keyboard pushbutton switch rests upon. The pushbutton switch can be used in electronic keyboards for computers or other similar devices.

It is another object of the present invention to provide a low profile pushbutton switch that is stabilized in its two horizontal axes, thereby maintaining the upper surface of the pushbutton switch normal to the direction of depression of the switch.

It is still another object of the present invention to provide a low profile pushbutton switch which can be closely spaced to adjacent similar pushbutton switches, while still maintaining a low profile for use with notebook or other computers and while maintaining stability in the movement of the pushbutton switch in both horizontal axes.

It is a further object of the present invention to provide a low profile pushbutton switch which does not demonstrate any significant resistance or binding during the depression or actuation of the pushbutton switch.

It is yet another object of the present invention to provide a low profile pushbutton switch that can work properly with a "full travel" stroke in the direction of depression of at least 3.0 millimeters, yet will also work without binding with a smaller stroke, such as 2.0 millimeters.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved low profile pushbutton switch is provided that has stabilization in both of its horizontal axes. This stabilization is achieved by a pair of yokes that are positioned at 90° angles from one another, and which provide stability to keep the upper surface of the pushbutton switch normal or perpendicular to the direction of depression as the switch is actuated. The first yoke is mounted via a "living hinge" to the base surface of the pushbutton switch, and is attached, via a pair of stems, to horizontal slots in a moveable frame portion that is rigidly attached to the upper cap of the pushbutton switch. As the switch is depressed, the stems of this first yoke will move in the horizontal direction within its horizontal slots in the moveable frame portion to allow stabilized vertical movement of the moveable frame portion. Each of the two stems of the first yoke are kept equidistant from the base surface of the pushbutton switch, although that distance varies. The moveable frame portion is thus stabilized, as the pushbutton switch is depressed, about a horizontal axis 90° from the first yoke's axis of movement (i.e, the axis created by the living hinge).

A second yoke is attached via a "living hinge" to the moveable frame portion, and additionally is attached at its opposite end, via a pair of stems, to horizontal slots in walls of the fixed base portion of the pushbutton switch. As the pushbutton switch is depressed, the stems of this second yoke can move in the horizontal direction within the slots, but are retained at a fixed vertical height with respect to the base surface. Since the stems remain equidistant from the base surface the moveable frame portion is thus stabilized as the pushbutton switch is depressed in a horizontal axis of movement 90° from the second yoke's axis of movement (i.e., the axis created by its living hinge).

These two yokes, therefore, maintain both horizontal axes normal or perpendicular to the direction of depression of the pushbutton switch, thereby keeping the upper cap of the pushbutton switch normal to the direction of movement as the pushbutton switch is depressed. If the pushbutton switch is provided with slots of sufficient length, the stems and their associated yolks can have a great enough travel to allow the stroke-to-profile ratio (defined hereinbelow) to be greater than 0.5.

The first and second yokes have center portions which are cut out so as to allow the two yokes to be interleaved within one another, thereby allowing the yokes to both fit within the confines of the moveable frame portion, which itself is the same size or smaller in length and width than the upper cap of the pushbutton switch. In addition, the middle cut-out portions of the yokes also allow for the use of a vertical rod to be attached to the bottom surface of the upper cap, which can have a coil spring fitted around its outer surface to provide the mechanical means for returning the pushbutton switch to its undepressed position after it has been actuated.

Still other objects of the present invention will become apparent to those skilled in this an from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the FIGS. 1 through 4 of the accompanying drawings, wherein like numerals indicate the same elements throughout the views.

Figure 1:
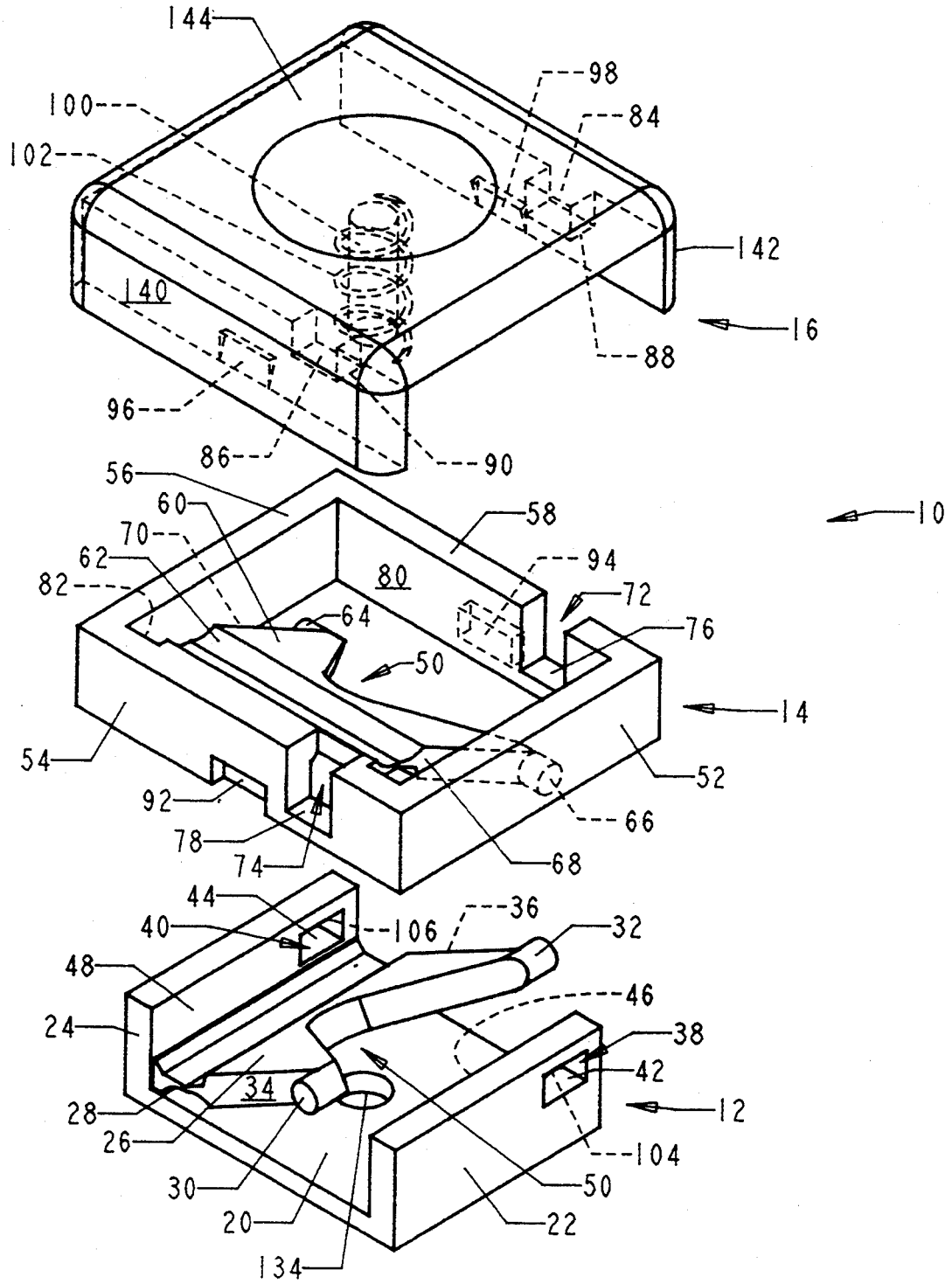
FIG. 1 is an exploded view of a low profile pushbutton switch constructed in accordance with the principles of the present invention.

Referring now to the drawings, FIG. 1 shows a low profile pushbutton switch generally designated by index numeral 10. Pushbutton switch 10 includes a fixed base portion 12, a moveable frame portion 14, and an upper cap portion 16.

Base portion 12 includes a base surface 20, a side wall 22, and a parallel, spaced apart, side wall 24. The combination of base surface 20 and side walls 22 and 24 can be molded separately as a one-piece unit, or, if used in a large electronic keyboard, base surface 20 could continue throughout the keyboard to provide a common base surface for all of the keyboard pushbutton switches. Such a keyboard surface would then have pairs of spaced-apart side walls located at regular intervals throughout the keyboard assembly.

A yoke 26 is provided to give mechanical stability between base portion 12 and the moveable frame portion 14. Yoke 26 is preferably made rigid with a thick cross section of a material such as Capron TM (a type of nylon), to provide the mechanical strength necessary for yoke 26 to maintain the stability of moveable frame portion 14. Yoke 26 is "V"-shaped with a large cut-out in its central, mid-portion, at the location designated by index numeral 50. Yoke 26 is permanently and pivotally attached to base surface 20 and side wall 24 via a "living hinge" 28, in which living hinge 28 allows rotation about a single horizontal axis. Living hinge 28 is made of the same (preferably nylon) material as the rest of yoke 26, and is manufactured to be thin enough in cross-sectional area to allow a flexible connection so that yoke 26 can pivot with respect to base surface 20 and side wall 24. Living hinge 28, however, must not be fragile, so as to provide a long operating life of several million operations before failure.

Yoke 26 has a pair of stems 30 and 32 located at the opposite end of yoke 26 from living hinge 28. Stems 30 and 32 are preferably cylindrical in overall shape, and are sized to fit within slots 72 and 74 of moveable frame portion 14. As can best be viewed in FIG. 2A, stems 30 and 32 are located in undepressed positions 110 and 114, respectively, when pushbutton switch 10 is not depressed. As best viewed in FIG. 2B, stems 30 and 32 are located in depressed positions 112 and 116, respectively, when pushbutton switch 10 has been depressed.

Stem 30 has one degree of mechanical freedom in that it can move within slot 74 only in the horizontal direction. Stem 30 can move from its undepressed position 110 to its depressed position 112 while being confined along its lower bearing surface 78 and its upper bearing surface 90 (which is provided by a protrusion 86 in the cap portion 16 that covers, when assembled, a portion of slot 74).

Stem 32 also has one degree of mechanical freedom in the horizontal plane as it moves from its undepressed position 114 to its depressed position 116. During this horizontal movement, stem 32 is confined by its lower bearing surface 76 and by its upper bearing surface 88 (which is part of a protrusion 84 in cap portion 16 that covers, when assembled, a portion of slot 72).

Moveable frame portion 14 is open at its top and bottom regions, and mainly consists of a rectangular set of frame members which are depicted in FIG. 1 as side walls 52, 54, 56 and 58. Side wall 54 contains slot 74, and side wall 58 contains slot 72.

The outer surface 34 of yoke 26 slides and wears against its inner matching surface 82 of wall 54, which acts as a bearing surface against the movement of yoke 26. On the opposite side of yoke 26, a corresponding outer surface 36 wears against its inside matching surface 80 of wall 58, which also acts as a bearing surface against the movement of yoke 26. The outer yoke surfaces 34 and 36 of yoke 26 are confined within matching inside surfaces 82 and 80 (of walls 54 and 58), respectively, and keep the frame portion 14 and attached cap portion 16 within the confines of the switch footprint. In other words, this mechanical action prevents rotation and horizontal sliding of cap portion 16.

These confined movements allow yoke 26 to have only two degrees of freedom. The first degree of freedom is in the vertical direction. The second degree of freedom is in one of the horizontal directions, such that moveable frame portion 14 cannot slide from side-to-side in the other horizontal direction (at side walls 54 and 58) as pushbutton switch 10 is actuated in the vertical direction. Yoke 26 may rotate about living hinge 28, however, its stems 30 and 32 may only move horizontally with respect to the movable frame portion 14.

A second yoke 60 is permanently and pivotally attached to side wall 54 of moveable frame portion 14 via a second living hinge 62, in which living hinge 62 allows rotation about a single horizontal axis (which is perpendicular to the horizontal axis about which living hinge 28 allows rotation). Yoke 60 is also "V"-shaped so that its center portion is cut-out at the center, open area 50. The V-shapes of yokes 26 and 60 allow both yokes to occupy the same vertical and horizontal profile without interfering with each other. Yoke 60 is preferably made rigid with a thick cross section of the same Capron TM material that yoke 26 is made from. As was the case with yoke 26 and living hinge 28, living hinge 62 is small enough in cross-sectional area to allow flexibility between side wall 54 and yoke 60, yet should be mechanically reliable for millions of operations. While the living hinge 28 of yoke 26 and the living hinge 62 of yoke 60 allow the entire base portion 12 of moveable frame portion 14 to be made of the same type of material, it will be understood that any type of hinge could be used in place of these living hinges.

Figure 2A:
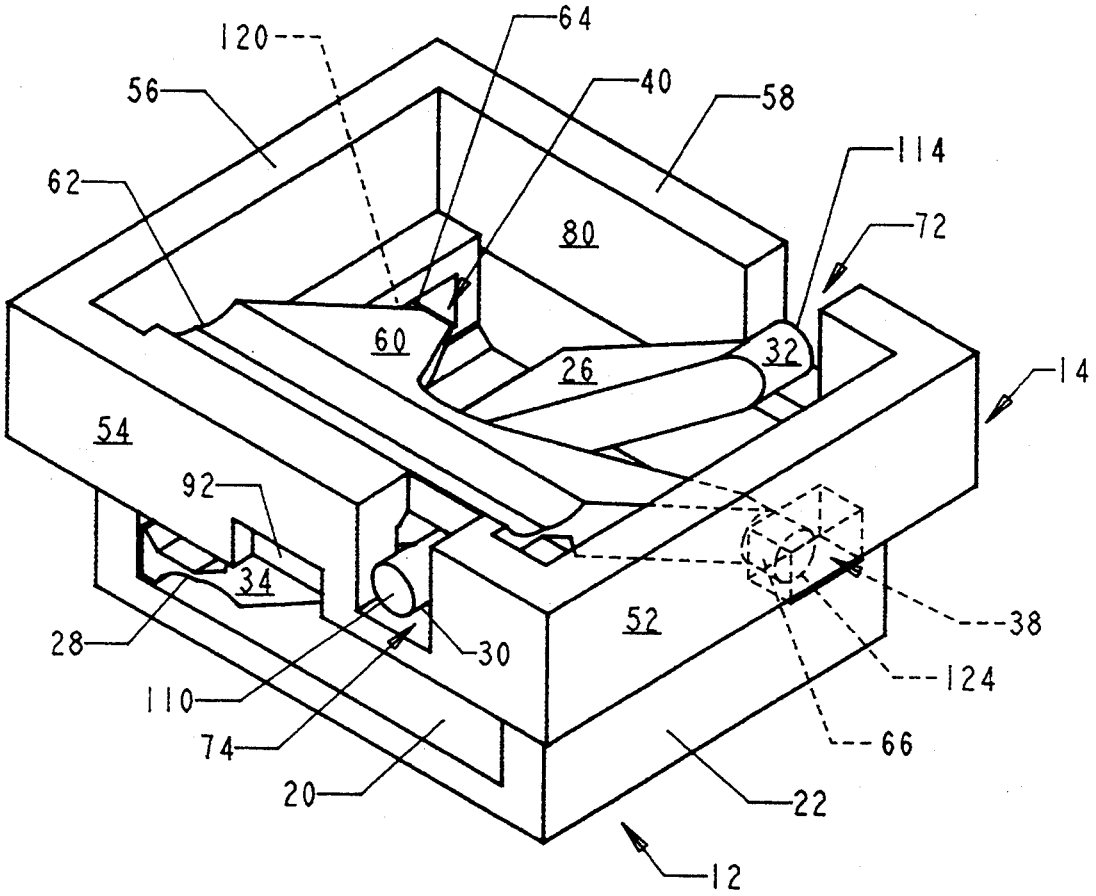
FIG. 2A is a perspective view of the fixed base portion and the moveable frame portion of the low profile pushbutton switch of FIG. 1, depicted in the undepressed position.
Figure 2B:
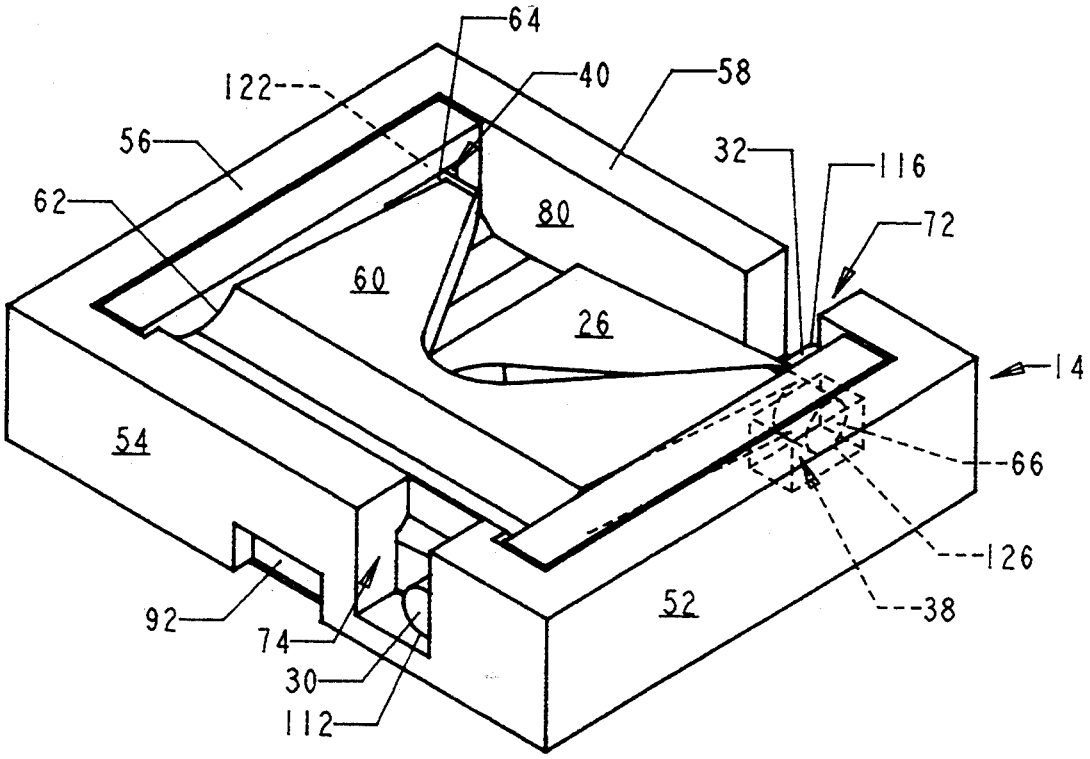
FIG. 2B is a perspective view of the lower fixed base portion and moveable frame portion of the low profile pushbutton switch of FIG. 1, depicted in the depressed position.

Yoke 60 includes two stems 64 and 66 which are preferably cylindrical and located, respectively, in slots 40 and 38 of base portion 12. Stem 66 has one degree of mechanical freedom within slot 38, and can move only horizontally against the lower bearing surface 42 and the upper bearing surface 104 of slot 38. Stem 64 also has one degree of mechanical freedom in that it can move horizontally within slot 40 against lower bearing surface 44 and upper bearing surface 106. Similarly to yoke 26, the stems 64 and 66 of yoke 60 can move between an undepressed position and a depressed position. For example, stem 64 can move from its undepressed position 120 (as seen in FIG. 2A) to its depressed position 122 (as seen in FIG. 2B). In a like manner, stem 66 can move from its undepressed position in 124 (see FIG. 2A) to its depressed position 126 (see FIG. 2B).

In a similar manner to yoke 26, the sides of yoke 60 wear against inside bearing surfaces of the side walls 22 and 24. The outer surface 68 of yoke 60 wears against a matching surface 46 along the inside of side wall 22. In a likewise manner, the outer surface 70 of yoke 60 wears against the matching surface 48, which is the inside surface of wall 24. The outer yoke surfaces 68 and 70 of yoke 60 are confined within matching inside surfaces 46 and 48 (of walls 22 and 24), respectively, and keep the frame portion 14 and attached cap portion 16 within the confines of the switch footprint. In other words, this mechanical action prevents rotation and horizontal sliding of cap portion 16.

These confined movements allow yoke 60 to have only two degrees of freedom. The first degree of freedom is in the vertical direction. The second degree of freedom is in one of the horizontal directions, such that moveable frame portion 14 cannot slide from side-to-side in the other horizontal direction (at side walls 52 and 56) as pushbutton switch 10 is actuated in the vertical direction. Yoke 60 may rotate about living hinge 62, however, its stems 64 and 66 may only move horizontally.

Figure 3:
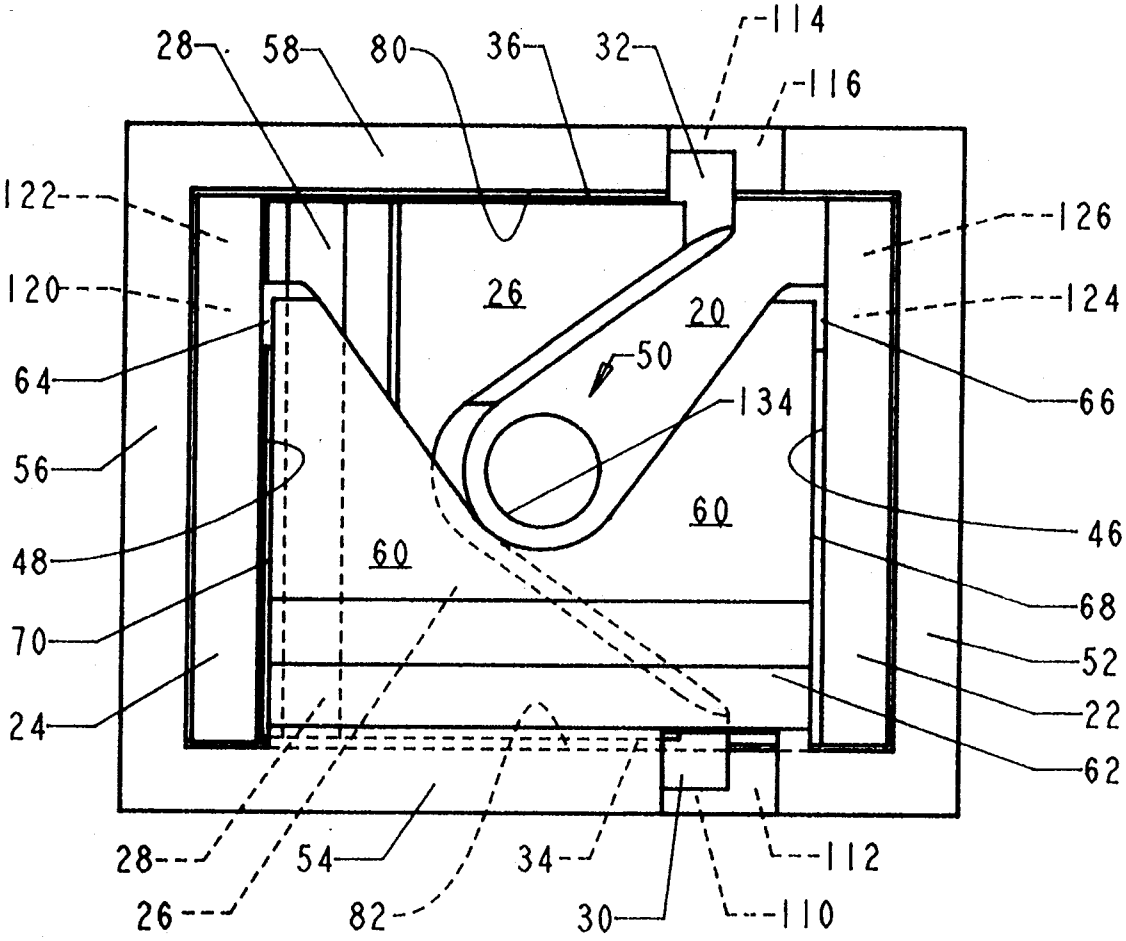
FIG. 3 is a top plan view of the low profile pushbutton switch of FIG. 1, depicting the fixed base portion and moveable frame portion.

The relationship between the yokes' 26 and 60 outer surfaces 68 and 70, 34 and 36, to their respective inner wall surfaces 46 and 48, 82 and 80, respectively, can be easily viewed in FIG. 3. The stems of both yokes 26 and 60 simultaneously move within their respective slots as the top cap portion 16 (not shown in FIG. 3) of pushbutton switch 10 is depressed or undepressed. As can be seen in FIGS. 2A, 2B, and 3, the "V"-shape of yokes 26 and 60 allows for them to move during actuation of pushbutton switch 10 without interfering with each other.

It will be understood that slots 38, 40, 72, and 74 are not required to be horizontal to effectively maintain their respective stems 66, 64, 32 and 34 equidistant from the base surface. In addition, slots 38, 40, 72 and 74 can be curved or otherwise shaped to provide a different feel to the operation of pushbutton switch 10.

It will be understood that if a person's finger touches any portion of horizontal panel 144 and depresses its surface, the stabilization effects of yokes 26 and 60 keep horizontal panel 144 substantially horizontal and do not allow cap portion 16 to become tilted or cocked such that it could bind upon actuation. If the vertical direction is a "z-axis", and the horizontal plane contains an "x-axis" and a "y-axis", a triordinate system is defined consisting of mutually perpendicular axes. Using this triordinate system, pushbutton switch 10 would be operated by depressing the cap portion 16 in the z-axis direction. Yoke 26, because of its rigidity, would not allow movable frame portion 14 to wobble or tilt about the x-axis, and yoke 60, likewise because of its rigidity, would not allow movable frame portion 14 to wobble or tilt about the y-axis. Yokes 26 and 60 thus provide a "dual stabilization" during the operation of pushbutton switch 10. It will additionally be understood that the axes defined by living hinges 28 and 62 of yokes 26 and 60, respectively, are not required to be in a perpendicular geometric relationship to one another to effectively stabilize the movements of pushbutton switch 10.

Recesses 92 and 94 (see FIG. 1) are located in side walls 54 and 58, respectively. Recess 92 is shaped to receive a wedge-shaped protrusion 96 which is located along the inner side wall 140 of upper cap portion 16. In a similar manner, recess 94 is shaped to receive a wedge-shaped protrusion 98 located on the side wall 142 of cap portion 16. Side walls 140 and 142 are joined together by horizontal panel 144, which is the upper surface of pushbutton switch 10 and is the surface that the fingers of the user touch while actuating pushbutton switch 10.

The central portion of horizontal panel 144 preferably has a vertical rod 100 attached to its inner, lower surface. A coil spring 102 is preferably placed around rod 100 and acts as a return spring once the top cap portion 16 has been depressed.

Rod 100 can be used to actuate a membrane switch 160 (see FIG. 4) located beneath a hole 134 in base surface 20 by protruding through hole 134 while pushbutton switch 10 is in its depressed position. Alternatively, a reed switch (not shown) could be located beneath hole 134 in base surface 20 so that it would be brought within close proximity to a magnet 130 located near the bottom tip of rod 100 (see FIG. 4) when pushbutton switch 10 is depressed.

It will be understood that both a membrane switch and a reed switch would not be used simultaneously in a typical application, but a choice would be made between one type of switch or the other. In addition, rod 100 could be of such a length as to penetrate through hole 134 in base surface 20 to be used to trigger some type of proximity detector (not shown), such as a metal-sensing proximity switch or an optical emitter/detector circuit located proximal to hole 134. Furthermore, rod 100 could be used to actuate a standard electromechanical switch (not shown) located beneath hole 134 in base surface 20. The various types of electrical switches that could be used with pushbutton switch 10 virtually are limited only to the type of sensors that are available at any given time.

The use of yokes 26 and 60 with their sliding bearing surfaces allow the "up" position profile (i.e., the vertical distance between the bottom inside surface of cap portion 16 and the bottom surface of the fixed base portion 12) to be less than twice the stroke, which is the distance travelled from the undepressed position to the depressed position. This allows for a space saving design yet still maintaining an optimum ergonomic stroke of at least 3.0 millimeters. In addition, the overall footprint (the length and width at base surface 20) of pushbutton switch 10 can be reduced to a point that allows the center-to-center placement of multiple switches to be less than 0.75 inches, while also providing a top surface area (of horizontal panel 144) that is large enough for sound ergonomic use.

It will be understood that yokes of other configurations could be used in pushbutton switch 10 without departing from the principles of the present invention. It will be further understood that mechanisms other than yokes with stems could be used to stabilize the movement of pushbutton switch 10 without departing from the principles of the present invention.

Figure 4:
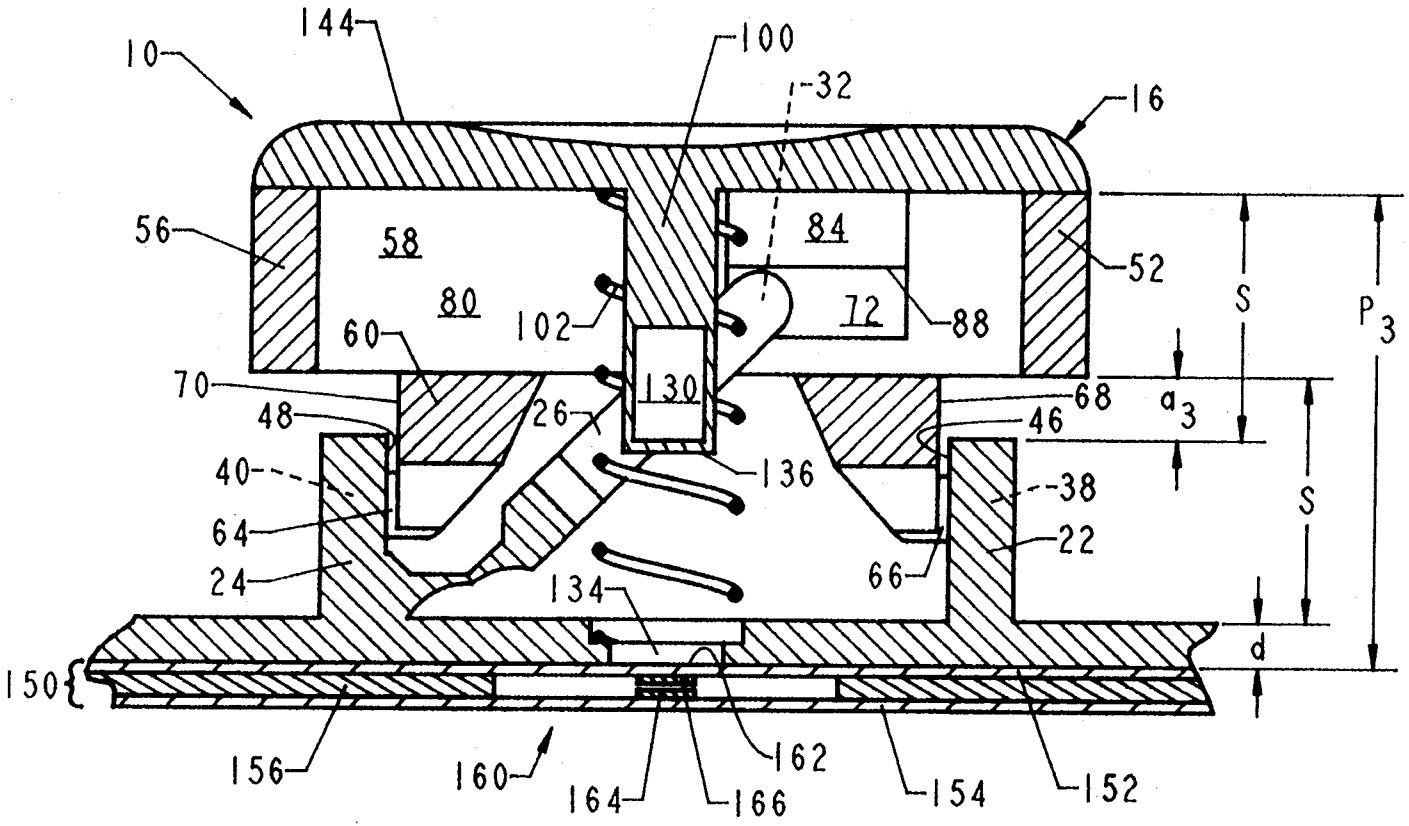
FIG. 4 is an elevational view in cross-section of the low profile pushbutton switch of FIG. 1 in its undepressed position, while additionally depicting a membrane switch below the surface of the base portion.
Figure 6:
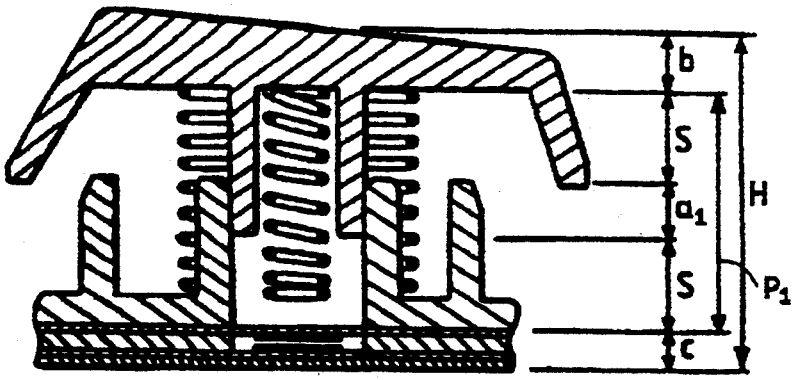
FIG. 6 PRIOR ART
FIG. 6 is an elevational view in cross-section of a prior art pushbutton switch, disclosed in FIG. 13 of Kato et al.

FIG. 4 is a cross-sectional view of low profile pushbutton switch 10 as it would be mounted upon a membrane switch assembly 150. Membrane switch assembly 150 typically would comprise a number of membrane switches, such as that generally designated by the index numeral 160. Typically, there would be an individual membrane switch 160 for each pushbutton switch 10 on a keyboard. The remaining portions of membrane switch assembly 150 would comprise a top and bottom Mylar TM layer, depicted by the index numerals 152 and 154, respectively, and a non-conductive plastic spacer 156 between the mylar layers. Each membrane switch 160 would typically include a target area 162 which would be actuated by an actuation area 136 at the bottom portion of rod 100. Membrane switch 160 would include a top conductive layer 166 and a bottom conductive layer 164, which are typically constructed by depositing conductive metal along the inner surfaces of mylar layers 152 and 154.

As related hereinabove, the stroke-to-profile ratio is desirably maintained as large as possible in pushbutton switches used in low profile applications, such as notebook computers. The desirable large ratio can easily be achieved with the low profile pushbutton switch 10 of the present invention by constructing slots 72, 74 (not shown on FIG. 4), 38, and 40 of sufficient length to allow for a maximized stroke. The distance travelled from the undepressed position to the depressed position is defined as the "stroke" on FIG. 4 and designated by the letter "S ", which is shown in two places on FIG. 4. The upper stroke S is the distance between the lower surface of the key cap 16 and the upper surface of sidewall 22. The lower stroke S is the distance between the lower surface of sidewall 52 and the upper surface of base 20. In an optimal design, these two stroke S dimensions would be equal to one another, and therefore, both stroke dimensions in FIG. 4 have been given a common designation, which will also be used as a variable name in equations of this disclosure.

Dimension "d" represents the thickness of base 20, which can be minimized while providing structural integrity for low profile pushbutton switch 10. Dimension "$a_3$" represents the distance between the lower surface of sidewall 52 and the upper surface of sidewall 22. By lengthening the slots, such as slot 72, dimension $a_3$ can be maximized as desired.

The "profile" of low profile pushbutton switch 10 in its undepressed position is designated by the dimension "$P_3$" in FIG. 4. Dimension $P_3$can be defined by the equation $(2S-a_3+d)$ which can be easily discerned by a close inspection of FIG. 4. With this definition, the stroke-to-profile ratio $S/P_3$ of low profile pushbutton switch 10 is equal to $S/((2S)-a_3+d)$. As long as dimension $a_3$ is greater than dimension d, this stroke-to-profile ratio $S/P_3$ will be greater than 0.5. As related above, dimension d can be minimized while maintaining structural integrity for the base portion 20 of low profile pushbutton switch 10. In addition, dimension $a_3$ can be maximized by having slots of sufficient length, such as depicted in FIG. 4 by slot 72.

Figure 5:
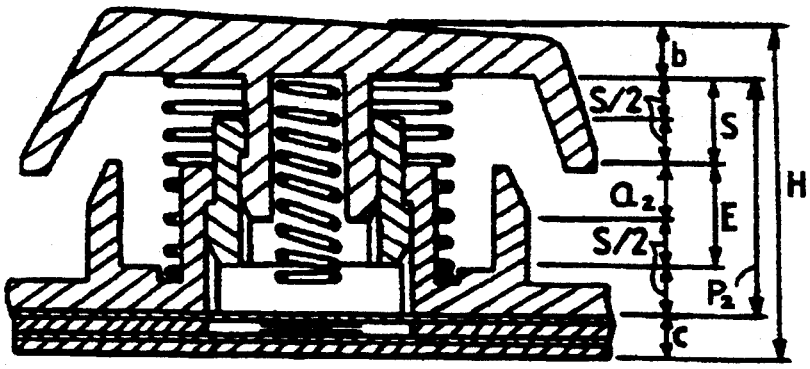
FIG. 5 PRIOR ART
FIG. 5 is an elevational view in cross-section of a prior art pushbutton switch, disclosed in FIG. 1 of Kato et al.

As used herein and in the claims, the term "maximizing the stroke-to-profile ratio" represents a ratio having a value greater than that achievable by Karo et al., for example, a number approaching 0.5 or greater. As related hereinabove, Kato et al. cannot achieve a stroke-to-profile ratio of 0.5 or greater, which is apparent from a close inspection of FIG. 5. Concerning the present invention, on the other hand, it will be understood that the slots of low profile pushbutton switch 10 can be made to any practical desired length to increase the travel of yolk 26 and yolk 60, thereby also increasing dimension $a_3$ (and increasing the stroke-to-profile ratio-see FIG. 4), while preventing a situation where the stems of these yokes would potentially bind within the slots. It will be further understood that the exact construction techniques depicted in the preferred embodiment may be varied to increase dimension $a_3$ without departing from the principles of the present invention.

In addition to the above, it will be understood that dimension d could be made equal to zero or near-zero by eliminating or minimizing the thickness of the portions of the base 20 in the design of low profile pushbutton switch 10 where its side walls 52, 54, 56 and 58 would normally rest against the top surface of base 20 in the depressed position.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A low profile pushbutton for mechanically interfacing between a human user's hand and a switch, comprising:

(a) a base, said base having at least one member defining a predetermined plane, said base having a bottom surface, said base including at least one perpendicular side wall member having a top surface;

(b) a frame, said frame being operationally movable with respect to said base in a direction generally perpendicular to said predetermined plane, said direction defining a first axis of a mutually perpendicular triordinate system;

(c) a cap, said cap being operationally movable with respect to said base in a direction generally perpendicular to said predetermined plane, said cap having a top tactile portion, said cap having a bottom surface;

(d) first stabilizing means for restricting the relative movement between said frame and said base about a second axis of said mutually perpendicular triordinate system, said second axis being perpendicular to said first axis; and (e) second stabilizing means for restricting the relative movement between said frame.and said base about a third axis of said mutually perpendicular triordinate system, said third axis being perpendicular to both said first and second axes, each of said first and second stabilizing means being interconnected with both said base and said frame, and being substantially disposed internally within the confines of the frame in the directions of the second and third axes;

wherein "S", designated as the stroke, represents the distance between said side wall member's top surface and said cap 's bottom surface when said pushbutton is in its undepressed position, "$P_3$" designated as the profile represents the distance between said base's bottom surface and said cap's bottom surface, and the stroke-to-profile ratio, equal to "S" divided by "$P_3$" is greater than or equal to 0.5.

2. The low profile pushbutton as recited in claim 1, wherein said frame transits a path along said first axis between an extended position and a depressed position during operation of said low profile keyboard pushbutton, wherein said extended position is distal with respect to said base, and said depressed position is proximal to said base, further comprising means for returning said frame from said depressed position to said extended position.

3. The low profile pushbutton as recited in claim 1, wherein the top tactile portion of said cap is substantially planar.

4. The low profile pushbutton as recited in claim 1, wherein said at least one member defining a predetermined plane of the base comprises a substantially planar surface.

5. The low profile pushbutton as recited in claim 1, wherein said frame comprises four members substantially forming a hollow rectangle.

6. The low profile pushbutton as recited in claim 1, further comprising a rod having a longitudinal axis substantially parallel to said first axis rigidly attached to the bottom surface of said top tactile portion of said cap, and a return spring proximal to said rod.

7. The low profile pushbutton as recited in claim 1, wherein said frame and said cap are rigidly interconnected.

8. The low profile pushbutton as recited in claim 1, wherein said first stabilizing means comprises a first yoke being interconnected to said base via a hinge, said first yoke being additionally interconnected to a first pair of slots in said frame via a first pair of stems, said first pair of slots allowing movement of said first pair of stems only in the direction of said second axis.

9. The low profile pushbutton as recited in claim 1, wherein said second stabilizing means comprises a second yoke being interconnected to said frame via a hinge, said second yoke being additionally interconnected to a second pair of slots in said base via a second pair of stems, said second pair of slots allowing movement of said second pair of stems only in the direction of said third axis.

10. The low profile pushbutton as recited in claim 1, wherein said frame comprises four members substantially forming a hollow rectangle; said first stabilizing means comprises a first yoke being interconnected to said base via a first hinge, said first yoke being additionally interconnected to a first pair of slots in said frame via a first pair of stems, said first pair of slots allowing movement of said first pair of stems only in the direction of said second axis; said second stabilizing means comprises a second yoke being interconnected to said frame via a second hinge, said second yoke being additionally interconnected to a second pair of slots in said base via a second pair of stems, said second pair of slots allowing movement of said second pair of stems only in the direction of said third axis; said first yoke further comprising two side edges which, along with the inside surface of two of the members of said frame, tend to constrain the movement of said first yoke by limiting its motions to only the first axis and the second axis; said base further comprising two walls perpendicular to the predetermined plane of said base; and said second yoke further comprising two side edges which, along with the inside surface of the two walls of said base, tend to constrain the movement of said second yoke by limiting its motions to only the first axis and the third axis.

11. A low profile pushbutton for mechanically interfacing between a human user's hand and a switch, comprising:

(a) a base having a planar surface a bottom surface, and two spaced apart walls protruding from said planar surface in a direction perpendicular to the planar surface, said perpendicular walls having a top surface;

(b) a rectangular frame having four members, said frame being operationally movable with respect to said base in a direction generally perpendicular to said planar surface, said direction defining a first axis of a mutually perpendicular triordinate system;

(c) a cap, said cap being operationally movable with respect to said base in a direction generally perpendicular to said planar surface, said cap having a top tactile portion that is substantially planar, said cap being rigidly interconnected to said frame, and said cap having a bottom surface;

(d) a first yoke that restricts the relative movement between said frame and said base about a second axis of said mutually perpendicular triordinate system, said second axis being perpendicular to said first axis, said first yoke being interconnected to said base via a first hinge, said first yoke being additionally interconnected to a first pair of slots in said frame via a first pair of stems, said first pair of slots allowing movement of said first pair of stems only in the direction of said second axis, said first yoke further comprising two sides edges which, along with the inside surface of two of the members of said frame, tend to constrain the movement of said first yoke by limiting its motions to only the first axis and the second axis; and (e) a second yoke that restricts the relative movement between said frame and said base about a third axis of said mutually perpendicular triordinate system, said third axis being perpendicular to both said first and second axes, said second yoke being interconnected to said frame via a second hinge, said second yoke being additionally interconnected to a second pair of slots in said base via a second pair of stems, said second pair of slots allowing movement of said second pair of stems only in the direction of said third axis, said second yoke further comprising two sides edges which, along with the inside surface of the two walls of said base, tend to constrain the movement of said second yoke by limiting its motions to only the first axis and the third axis;

wherein "S", designated as the stroke represents the distance between said perpendicular walls' top surface and said cap 's bottom surface when said pushbutton is in its undepressed position, "$P_3$" designated as the profile, the distance between said base's bottom surface and said cap's bottom surface, and the stroke-to-profile ratio, equal to "S" divided by "$P_3$" is greater than or equal to 0.5.

12. A low profile keyboard pushbutton as recited in claim 11, wherein said first and second yokes are interleaved with one another and are substantially disposed internally within the confines of the frame in the directions of the second and third axes.

13. A low profile keyboard pushbutton as recited in claim 11, further comprising a rod having a longitudinal axis substantially parallel to said first axis rigidly attached to the bottom surface of said cap, and a return spring proximal to said rod.

14. A low profile keyboard pushbutton as recited in claim 13, further comprising a membrane switch which is actuated by said rod when said keyboard pushbutton is actuated.

15. A low profile keyboard pushbutton as recited in claim 13, further comprising a combination optical detector and light source which is actuated by said rod when said keyboard pushbutton is actuated.

16. A low profile keyboard pushbutton as recited in claim 13, further comprising a magnetic reed switch which is actuated by a magnet located in said rod when said keyboard pushbutton is actuated.

17. A low profile keyboard pushbutton as recited in claim 13, further comprising an electromechanical switch which is actuated by said rod when said keyboard pushbutton is actuated.

18. A low profile keyboard pushbutton as recited in claim 11, wherein said first and second hinges are living hinges.

19. A low profile keyboard pushbutton for mechanically interfacing between a human user's hand and a switch, comprising:

(a) a base, said base having at least one member defining a predetermined plane, said base having a top surface and a bottom surface;

(b) a frame, said frame being operationally movable with respect to said base in a direction generally perpendicular to said predetermined plane, said frame having a bottom surface;

(c) a cap, said cap being operationally movable with respect to said base in a direction generally perpendicular to said predetermined plane, said cap having a top tactile portion, said cap having a bottom surface;

(d) means for operatively connecting said base and said cap, said means stabilizing the movement of said cap;

wherein "S", designated as the stroke, represents the distance between said base's top surface and said frame's bottom surface when said pushbutton is in its undepressed position, "$P_3$" designated as the profile, represents the distance between said base's bottom surface and said cap's bottom surface, and the stroke-to-profile ratio, equal to "S" divided by "$P_3$" is greater than or equal to 0.

20. The low profile keyboard pushbutton as recited in claim 19, wherein said base includes at least one perpendicular side wall member having a top surface, and wherein "S" represents the distance between said side wall member's top surface and said frame's bottom surface when said pushbutton is in its undepressed position.

21. The low profile keyboard pushbutton as recited in claim 20, wherein "$a_3$" represents the distance between said side wall member's top surface and said frame's bottom surface, "d" represents the distance between said base's top and bottom surfaces, and the stroke-to-profile ratio is equal to "S" divided by "$P_3$", wherein "$P_3$" is equal to the mathematical term "$(2S)-a_3+d$".

* * * * *

UNITED STATES PATENT AND TRADEMARK OFFICE

CERTIFICATE OF CORRECTION

PATENT NO. : 5,424,516

DATED : June 13, 1995

INVENTOR(S) : Charles E. Emmons

It is certified that error appears in the above-indentified patent and that said Letters Patent is hereby corrected as shown below:

Column 11, line 10, (claim 1), insert --,-- after --"$P_3$"--

Column 11, line 11, (claim 1), insert --,-- after --profile--

Column 12, line 63, (claim 11), insert --,-- after --stroke--

Column 12, line 66, (claim 11), insert --,-- after --"$P_3$"--

Column 12, line 67, (claim 11), insert --represents-- after "profile,"

Column 14, line 19, (claim 19), insert --,-- after --"$P_3$"--

Column 14, line 23, (claim 19), insert --5.-- after "0."

Signed and Sealed this

Twenty-fourth Day of October, 1995

*Attest:*

*Attesting Officer*

Bruce Lehman

BRUCE LEHMAN

*Commissioner of Patents and Trademarks*